United States Patent [19]

Allen et al.

[11] Patent Number: 4,905,285

[45] Date of Patent: Feb. 27, 1990

[54] ANALYSIS ARRANGEMENT BASED ON A MODEL OF HUMAN NEURAL RESPONSES

[75] Inventors: Jont B. Allen, Scotch Plains; Oded Ghitza, Westfield, both of N.J.

[73] Assignee: American Telephone and Telegraph Company, AT&T Bell Laboratories, Murray Hill, N.J.

[21] Appl. No.: 317,104

[22] Filed: Feb. 28, 1989

Related U.S. Application Data

[63] Continuation of Ser. No. 34,815, Apr. 3, 1987, abandoned.

[51] Int. Cl.[4] ..... G10L 5/00

[52] U.S. Cl. ..... 381/41; 364/513.5; 364/487; 128/419

[58] Field of Search ..... 381/41–43; 364/513.5, 487; 128/419 R

[56] References Cited

U.S. PATENT DOCUMENTS

| | | | |
|---|---|---|---|
| 4,075,423 | 2/1978 | Martin et al. | 179/15 C |
| 4,532,930 | 8/1985 | Crosby et al. | 128/419 R |
| 4,536,844 | 8/1985 | Lyon | 364/487 |

OTHER PUBLICATIONS

Electronics, vol. 57, "Recognition System Processes Speech the Way the Ear Does", J. R. Lineback, pp. 45–46.

IEEE ASSP Magazine, 1/85, "Cochlear Modeling", J. B. Allen, pp. 3–29.

Journal of the Acoustical Society of America, vol. 63, 1978, "Auditory-Nerve Response from Cats Raised in a Low Noise Chamber", pp. 442–455, M. C. Liberman.

*Primary Examiner*—Emanuel S. Kemeny

*Attorney, Agent, or Firm*—William Ryan

[57] ABSTRACT

A sensory type pattern such as a speech or other sound pattern is analyzed to obtain the spectral distribution of the neural response thereto. A plurality of logarithmically related neural response intensity threshold signals is formed. The frequency spectrum of the sensory type pattern is divided into a plurality of overlapping spectral portions and the waveform of each prescribed spectral portion is partitioned into successive time segments. For the current time segment of each spectral portion waveform, the time intervals between crossings of the neural response intensity threshold level signals by the spectral portion waveform are detected and signals representative of the counts of inverse time intervals between the crossings of the plurality of levels are generated to form an inverse time interval histogram for the spectral portion. The inverse time interval histogram signals for the plurality of spectral portions are combined to produce a signal corresponding to the spectral distribution of the neural response to the sensory type pattern of the time segment.

41 Claims, 12 Drawing Sheets

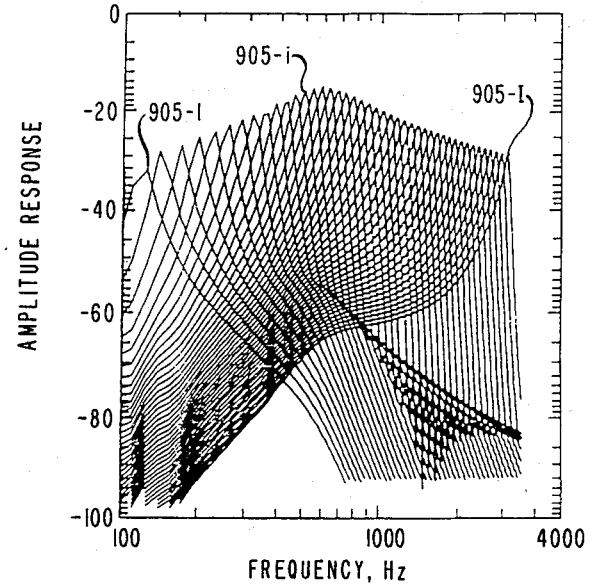
FIG. 9
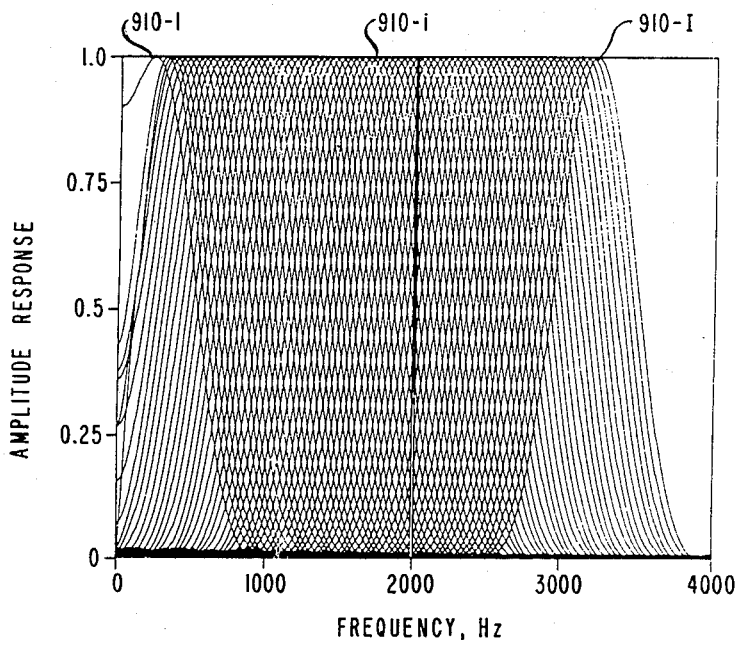

ANALYSIS ARRANGEMENT BASED ON A MODEL OF HUMAN NEURAL RESPONSES

This application is a continuation of application Ser. No. 34,815, filed on May 3, 1987, now abandoned.

FIELD OF THE INVENTION

The invention relates to signal processing and more particularly to processing arrangements for forming signals representative of sensory information based on a model of human neural responses.

BACKGROUND OF THE INVENTION

Many different types of processing arrangements have been devised to analyze sensory information. With respect to sensory signals derived from sounds such as speech, some processing systems extract specific features such as pitch, formants, or linear predictive parameters to detect, recognize, enhance or synthesize the speech or sounds. Other systems are adapted to form frequency spectra directly from the speech wave. It is generally agreed that the human heating apparatus does not process speech waves in these or similar ways and that human perception of speech for recognition or other purposes is superior to such automatic processing systems.

Little is known about the processing principles in the brain stem, auditory nuclei and the auditory cortex. It is well recognized, however, that sound waves entering the ear cause hair cells in the cochlea to vibrate, and that the sound waves are represented at the cochlear nucleus solely by the auditory nerve firing patterns caused by the hair cells in the cochlea. Such knowledge has been utilized as described for example in U.S. Pat. No. 4,532,930 issued to Peter A. Crosby et al., on Aug. 6, 1985 to provide auditory prosthesis for profoundly deaf persons. It is further known that human understanding of speech in the presence of noise is very good in comparison to automated recognition arrangements whose performance deteriorates rapidly as the noise level increases. Consequently, it has been suggested in the article "Recognition system processes speech the way the ear does" by J. R. Lineback appearing in Electronics, vol. 57, No. 3, Feb. 9, 1984, pp. 45–46 and elsewhere, that speech analysis may be modeled on the auditory nerve firing patterns of the human hearing apparatus.

U.S. Pat. No. 4,536,844 issued to Richard F. Lyon, Aug. 20, 1985, discloses a method and apparatus for simulating aural response information which are based on a model of the human hearing system and the inner ear and wherein the aural response is expressed as signal processing operations that map acoustic signals into neural representations. Accordingly, the human ear is simulated by a high order transfer function modeled as a cascade/parallel filter bank network of simple linear, time invariant filter sections with signal transduction and compression based on half-wave rectification with a nonlinearly coupled variable time constant automatic gain control network. These processing arrangements, however, do not correspond to the nerve firing patterns characteristic of aural response.

U.S. Pat. No. 4,075,423 issued to M. J. Martin et al. on Feb. 21, 1978 disclosed sound analyzing apparatus for extracting basic formant waveforms present in a speech signal, and examining the format waveforms to identify the frequency components thereof using a histogram of the frequency patterns of detected waveform peaks developed over successive sampling periods in a digital processor. The Martin et al arrangement, however, is limited to forming a particular set of acoustic features, i.e., formants but does not address the problem of utilizing the information available in the time differences of level crossings to characterize the acoustic wave more fully than the generation of the few formants there disclosed. In particular, the Martin et al arrangement treats each of the frequency sub-band components of the acoustic wave completely separately. Others have employed techniques somewhat similar to the techniques of the Martin et al patent and have also limited their analysis to formant extraction. See the article by Russell J. Niederjohn et al, "A Zero-Crossing Consistency Method for Format Tracking of Voiced Speech in High Noise Levels", IEEE Transactions on Acoustics, Speech and Signal Processing, vol. ASSP-33, No. 2, Apr. 1985, the article by M. Elghonemy et al, "An Iterative Method for Formant Extraction Using Zero-Crossing Interval Histograms" Melecon '85, vol. II, Digital Signal Processing, A. Luque et al (eds.) Elsevier Science Publishers B. V. (North-Holland) 1985, and the article of one of us, O. Ghitza, "A Measure of In-Synchrony Regions in the Auditory Nerve Firing Patterns as a Basis for Speech Vocoding", International Conference, Acoustics, Speech and Signal Processing, '85, Tampa, Fla., Mar. 26–29, 1985. In the latter article the analysis is advanced, with respect to the different frequency subband components of the acoustic wave, by a nonlinear combination thereof which picks "dominant frequencies" when present in at least 6 adjacent bands and suppresses other distributional information regarding the crossing time differences. We now believe that process causes the loss of valuable information regarding the input bandlimited signal, and that an analysis (a multiplicative nonlinear process) as employed in the article by the other of us, J. B. Allen, "Cochlear Modeling", IEEE ASSP Magazine, January, 1985 has disadvantages in characterizing the input bandlimited signal. It is an object of the invention to provide improved spectral representation of the neural response to sensory patterns that simulates the operation of biological organs and to adapt the technique to processing of bandlimited signals generally.

BRIEF SUMMARY OF THE INVENTION

The foregoing object is achieved by performing a timing synchrony analysis on a sensory pattern in which the spectrum of the sensory pattern is divided into spectral portions and the spectral distribution of neural response to the sensory pattern waveform is obtained using multilevel neural response thresholds. Nerve firing patterns are detected and the spectral distribution of the counts of nerve firings of the individual spectral portions are combined to form a spectral representation corresponding to the operation of the sensory organ. For sound patterns, multilevel sound intensity thresholds are established and crossings of the plurality of sound intensity thresholds by the spectral portion waveforms are counted to produce a neural response histogram. The spectral portion histograms are combined to produce an auditory spectral representation of the input sound pattern.

The invention is directed to a sensory type pattern analysis arrangement in which a plurality of neural response intensity levels is defined. The frequency spectrum of a received sensory type pattern is divided into a plurality of spectral portions by filters each having a prescribed spectral response. The output of each filter is partitioned into successive time segments. Responsive to the output of each filter in the present time segment, a set of signals is generated which represent a histogram of the inverse time intervals between crossings of each of the neural response intensity levels by the filter output as a function of frequency for the present time segment. The inverse interval histogram signals from the filters for the present time segment are combined to produce a signal corresponding to the spectral distribution of the neural responses to the time segment waveform of the sensory pattern. Autocorrelation signals for the time segment formed from the neural response spectral distribution signals permit accurate speech recognition in high noise environments.

BRIEF DESCRIPTION OF THE DRAWING

FIG. 9 shows waveforms illustrating the spectral portion filtering in the arrangement of FIG. 1;

DETAILED DESCRIPTION

Figure 1:
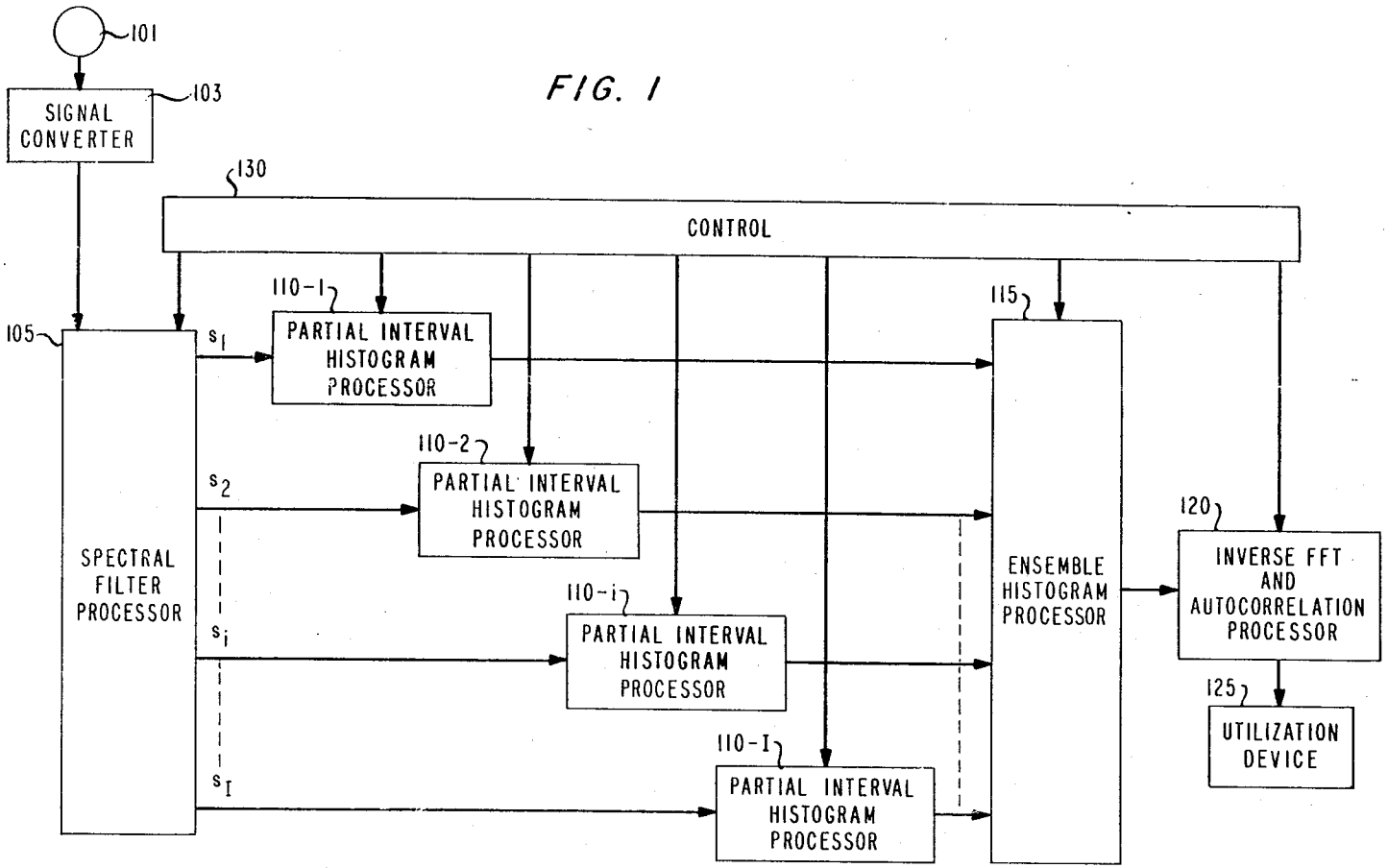
FIG. 1 depicts a general block diagram of an arrangement illustrative of the invention which produces spectral representations based on auditory neural patterns responsive to sounds.

FIG. 1 depicts a general block diagram of an arrangement adapted to analyze sensory information by partitioning an input signal into a plurality of spectral portions, detecting occurrences of particular events in each spectral portion i.e., crossings of sensory thresholds, and combining event information i.e., counts of intervals between sensory threshold crossings for evaluation. While FIG. 1 is described in terms of a speech analyzer, it should be understood that it may be used for the spectral analysis of visual or other sensor like signals. The circuit of FIG. 1 produces a frequency domain representation of an input sound measured from firing patterns generated by a simulated nerve fiber array and simulates the temporal characteristics of the information in the auditory nerve fiber firing patterns by transforming the frequency domain representation into autocorrelation signals for use in speech processing. As a result, the information obtained therefrom corresponds to that derived from the human hearing mechanism rather than that obtained by a direct analysis of a signal from an electroacoustic transducer. Priorly known human hearing simulation arrangements are based on a single auditory nerve threshold level and produce only limited auditory feature information. The simulation circuit according to the invention utilizes a plurality of auditory nerve threshold levels to provide much better resolution of the auditory response.

The model of human hearing used for the circuit of FIG. 1 comprises a section representing the peripheral auditory system up to the auditory nerve level. This section simulates the mechanical motion at ever point along the basilar membrane as the output of a narrow band-pass filter with frequency response produced by the mechanical tuning characteristics at that place as described in the article "Cochlear Modeling" by J. B. Allen appearing in the IEEE ASSP Magazine, January 1985, page 3. The shearing motion between the basilar membrane and the sectorial membrane is sensed by the cilia of the inner hair cell and transduced, in a highly nonlinear manner, to the primary nerve fibers attached to the cell. Each of these fibers is characterized by its threshold level and its spontaneous rate as disclosed in the article "Auditory-Nerve Response from Cats Raised in a Low-Noise Chamber" by M. C. Liberman appearing in Journal of the Acoustical Society of America, vol. 63, 1978, pp. 442–455. The mapping of places along the basilar membrane to frequency is approximately logarithmic, and the distribution of the inner hair cells along the membrane is uniform.

The filtering section may be represented by a plurality of filters each having a prescribed response corresponding to the cochlea. A set of 85 such cochlear filters equally spaced on a log-frequency scale from 0 Hz to 3200 Hz may be used. It is to be understood, however, that other filter characteristics may be used depending on the intended use of the analyzer. The nerve fiber firing mechanism is simulated, according to the invention, by a multilevel crossing detector at the output of each cochlear filter. In contrast to other arrangements which assume a single nerve fiber at each point in the basilar membrane, the arrangement according to the invention is in accordance with a multifiber model in which each fiber fires at a different sound intensity threshold. We have found that the multilevel arrangement corresponds more closely to the physiology of hearing and provides improved spectral representation in the presence of noise. The level crossings measured at threshold levels corresponding to predetermined sound intensities are uniformly distributed in a log scale over the dynamic range of the signal. While positive going threshold levels are used in embodiment described herein and positive going crossings of the threshold levels are measured, it is to be understood that other threshold and crossing arrangements may be used. The ensemble of the multilevel crossing intervals corresponding to the firing activity at the auditory nerve fiber-array. The interval between each successive pair of same direction, e.g., positive going, crossings of each predetermined sound intensity level is determined and a count of the inverse of these interspike intervals of the multilevel detectors for each spectral portion is stored as a function frequency. The resulting histogram of the ensemble of inverse interspike intervals forms a spectral pattern that is representative of the spectral distribution of the auditory neural response to the input sound. Advantageously, the ensemble histogram pattern is relatively insensitive to noise compared to priorly known Fast Fourier Transform derived spectra. The auditory neural response is the firing pattern of the ensemble of primary fibers in the auditory nerve.

FIG. 1, sound waves such as speech are converted into an electrical signal s(t) by a transducer 101 which may be a microphone. Signal s(t) is sampled at a prescribed rate, e.g., 40 Ksamples/sec., and the successive samples are converted in digital representations thereof in signal converter 103. The digitally coded signal is applied to filter processor circuit 105. The filter processor which may comprise a processor arrangement incorporating for example the type MC68020 microprocessor or the type TMS 32020 digital signal processor is operative to partition the digitally coded sequence corresponding to signal s(t) into a plurality of prescribed spectral potion signals $s_1, s_2, \ldots s_i, \ldots s_I$ by means of spectral filtering well known in the art. Each spectral portion may have the prescribed characteristic of a cochlear filter as aforementioned. Alternatively, each spectral portion may have a Hamming window type or other type characteristic well known in the art. Waveforms 905-1 through 905-I of FIG. 9 show the spectral characteristics of the passbands of such a set of cochlear filter characteristics, and waveforms 910-1 through 910-I illustrate the spectral response of a set of overlapping Hamming window type filters.

The spectral portions defined in filter processor 105 generally have a dominant frequency range that is relatively narrow. As a result, the spectral portion signal in the time domain comprises a sinewave type signal having relatively slowly changing peaks. The spectral portion signals may also be generated by applying the output of transducer 101 to a plurality of analog filters each having a prescribed spectral response. The spectral portion from each filter is then applied to a digital converter circuit operative to same the filter output at a prescribed rate and to transform the sampled filter output into a sequence of digital codes. The spectral portion digital codes from the converter circuits then corresponds to prescribed spectral portion signals $s_1, s_2, \ldots s_i, \ldots s_I$.

Figure 7:
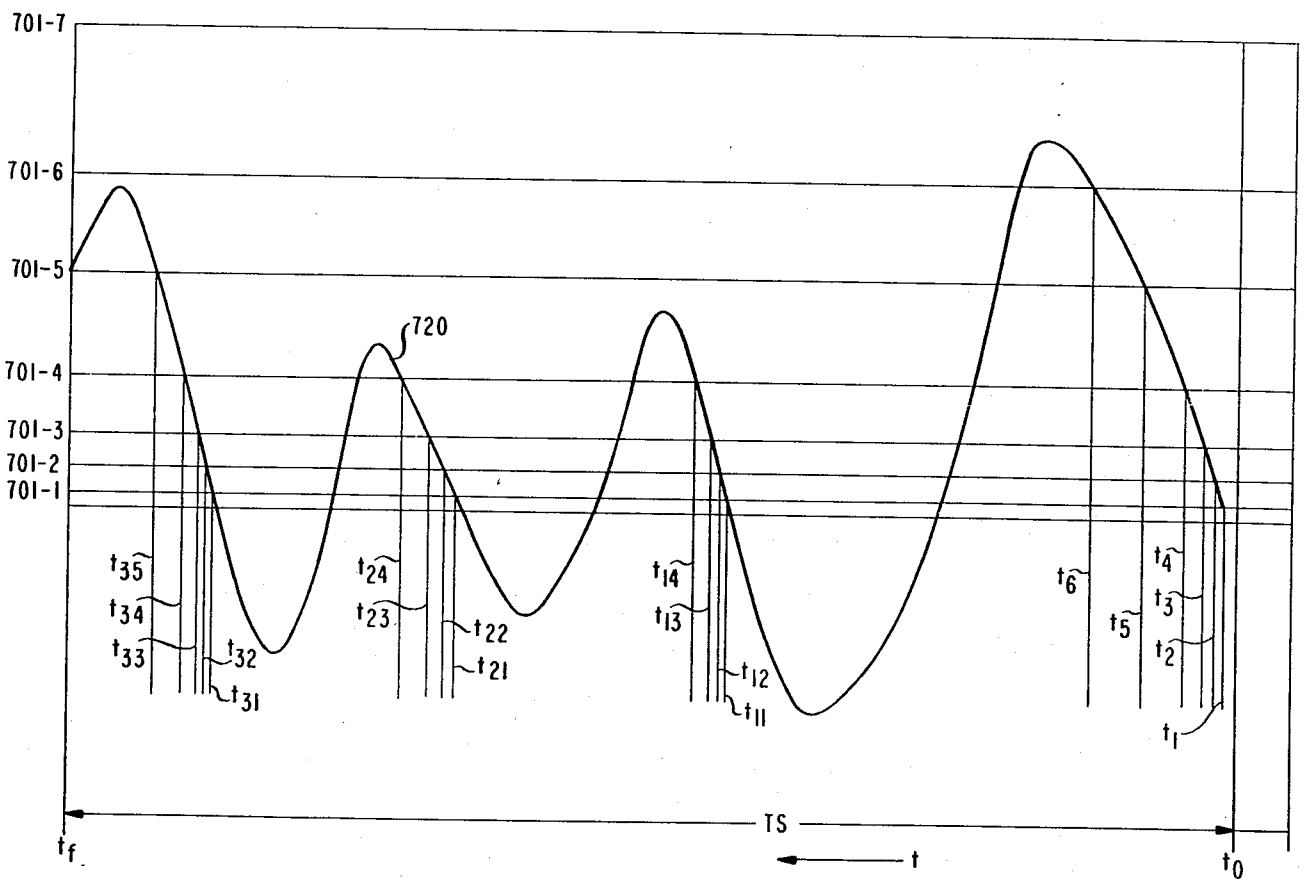
FIG. 7 show waveforms illustrating the operation of the partial interval histogram processors of FIG. 1.

The time domain digital signal sequence for prescribed spectral portion $s_1$is applied to partial interval histogram processor 110-1. Similarly, prescribed spectral portions $s_2, \ldots s_i, \ldots s_I$ are supplied to partial interval histogram processors 110-2 through 110-I, respectively. Each partial interval histogram processor is operative to detect the time intervals between crossings of the sound intensity levels by the spectral portion waveform as illustrated in FIG. 7 and to store the counts of the inverse time intervals as a function of frequency. Referring to FIG. 7, waveform 720 represents a time segment of the output in analog form from signal converter 107-1. A prescribed time segment, e.g., 40 milliseconds, is selected for all partial interval histogram processors although as will be explained the time segment may be further limited to a particular number of detected time intervals, e.g., 20. Waveforms 701-1 through 701-7 are a succession of positive threshold levels scaled logarithmically as indicated in FIG. 7.

Processor 110-1 is adapted to detect same direction, i.e., positive going crossings, of the same sound intensity level by the spectral portion waveform within the prescribed time segment TS and to generate signals each representing the inverse of the time interval of each successive pair of positive going sound intensity level crossings. The analysis time segment TS starts at the present time $t_0$ and extends into the past (right to left) until time $t_f$. Waveform 720 is a typical analog representation of the input spectral portion waveform to partial interval histogram processor 110-1. Waveform 720, while positive going, crosses level 701-1 at time $t_1$, $t_{11}$, $t_{21}$, and $t_{31}$ going right to left. These positive going crossings are detected and a signal corresponding to the inverse interval between each pair of successive crossings is obtained. With respect to level 701-1 in FIG. 7, indications of the inverse intervals $1/(t_{11}-t_1)$, $1/(t_{21}-t_{11})$ and $1/(t_{31}-t_{21})$ are recorded in a histogram store having bins or storage cells arranged according to inverse interval frequency. In similar fashion, inverse intervals $1/(t_{12}-t_2)$, $1/(t_{22}-t_{12})$, and $1/(t_{32}-t_{22})$ are formed for level 701-2, inverse intervals $1/(t_{13}-t_3)$, $1/(t_{23}-t_{13})$, and $1/(t_{33}-t_{23})$ for level 701-3, and inverse intervals $1/(t_{14}-t_4)$, $1/(t_{24}-t_{14})$, and $1/(t_{34}-t_{24})$ for level 704-4. With respect to level 701-5, only inverse interval $1/(t_{35}-t_5)$ is generated. No inverse time intervals are obtained for level 701-6 since there is only one crossing of this level at time $t_6$.

Counts of the inverse intervals are stored in the histogram bins which are memory locations arranged according to a frequency scale. The first bin may correspond to a frequency range between 0 and 32 Hz. The nex bin then corresponds to the frequency range Δ of 32 Hz-64 Hz. Other bins are arranged in like manner to cover the frequency spectrum of interest e.g., 0–3200 Hz. Assume for purposes of illustration that inverse intervals $1/(t_{11}-t_1)$, $1/(t_{21}-t_{11})$ $1/(t_{31}-t_{21})$ $1/(t_{12}-t_2)$, $1/(t_{22}-t_{12})$, $1/(t_{32}-t_{22})$ $1/(t_{13}-t_3)$, $1/(t_{23}-t_{13})$, and $1/(t_{33}-t_{23})$ are all in the frequency range of a single bin. According to the invention, that bin will store the number of inverse time intervals within its range, i.e., 9, obtained in the time segment TS being analyzed. Inverse intervals $1/(t_{14}-t_4)$, $1/(t_{24}-t_{14})$, and $1/(t_{34}-t_{24})$ for level 704-4 may fall within the range of an adjacent bin so that the count in the adjacent bin for time segment TS would be 3. The inverse time interval $1/(t_{35}-t_5)$ of course falls within a completely different frequency range and a count of 1 would be stored in the bin corresponding to that frequency range.

The bin counts are representative to the synchrony in the neural firing pattern of the cochlea. The use of a plurality of logarithmically related sound intensity levels accounts for the intensity of the input signal in a particular frequency range. Thus, a signal of a particular frequency having high intensity peaks results in a much larger count in the bin covering that frequency than a low intensity signal of the same frequency. The counts are independent of the spectral portion source in which they occurred. Priorly known histogram analysis arrangements utilize a single crossing count or peak counts so that variations in intensity are not readily detectable. In accordance with the invention, multiple level histograms of the type described herein readily indicate the intensity levels of the nerve firing spectral distribution and cancel noise effects in the individual intensity level histograms.

As is well known in the art, the use of a predetermined time segment for signal analysis tends to average the data obtained over the time segment. While a time segment of 40 milliseconds is appropriate for the analysis of low frequency spectral portions, it may not be appropriate for signal components in the high frequency spectral portions. A different time segment may be used for each spectral portion so that an appropriate time scale may be obtained for each spectral range. In the partial interval histogram circuit of FIG. 1, the time segment is made appropriate for each spectral range by using overlapping segments of TS duration. For example, the time segment duration for the analysis may be nominally 40 milliseconds while each analysis occurs every 5 milliseconds. The nominal TS segment is changed so that there is a maximum number of counts permitted in each bin of the histogram store. Consequently, a high count for a bin in effect shortens the time segment TS for that bin. Higher counts are expected for the higher frequency components of the input signal where the signal makes more level crossings within a given time. The time segment for such higher components is relatively short compared to the time segments for lower frequency components. Thus, the time resolution for the higher frequency components is made finer than for lower frequency components.

Figure 10:
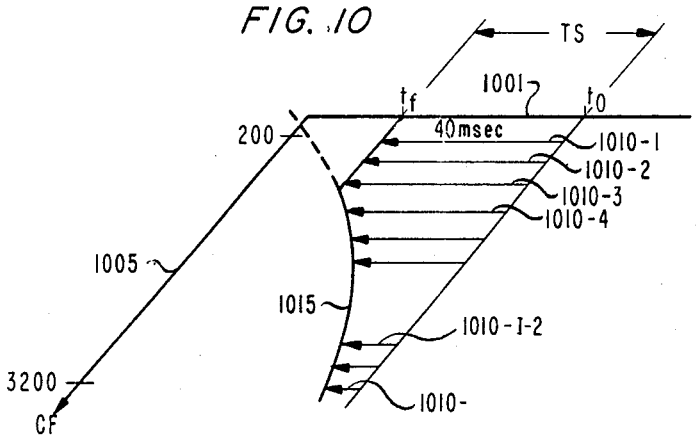
FIG. 10 shows curves illustrating time segment arrangements in the circuit of FIG. 1.

FIG. 10 illustrates the variable time interval arrangement. Line 1001 represents the time axis and time segement $t_O$–$t_f$ is marked as a sampling time period at which the analysis is performed. Line 1005 represents the frequency axis along which are a low frequency limit, e.g., 200 Hz and a high frequency limit, e.g., 3200 Hz. An analysis time segment TS, e.g., 40 milliseconds, shown by line 1010-1 is used at the low frequency limit at which a maximum inverse interval count of 20 cannot be expected. Similarly, a 40 millisecond analysis interval is used at somewhat higher frequencies as indicated by line 1010-2 and 1010-3. Line 1010-4, however, is at a frequency where a count of 20 results in a shorter interval than TS=40 milliseconds. In the highest frequency ranges, the count of 20 occurs within a much shorter analysis window as indicated by lines 1010-)(I-2) and 1010-I. The resulting analysis window is indicated by curve 1015 which is of 40 milliseconds duration at low frequencies and decreases at higher frequencies. Thus, a long analysis window TS takes into account the effects of low frequency components while the shorter window obtained by limiting the count of inverse time intervals permits accurate analysis of high frequency changes.

As an illustration of the partial interval histogram operation, consider an input signal of the form $$s(t)=A\ sin(2\pi f_0 t) \tag{1}$$

applied to a cochlear type filter of FIG. 9 having a center frequency $$CF=f_o \tag{2}$$

For a given intensity A, the output signal of the cochlear filter will provide only some sound intensity level-crossings. For a given level, the time interval between two successive up going level crossings is generally $1/f_0$ and the inverse of this time interval is $f_0$. Since a histogram of the inverse of the intervals is generated, this interval between a pair of positive going crossings contributes one count to the $f_0$ bin of the histogram. For the illustrative input signal of frequency $f_0$, all the intervals are identical. This results in a histogram which is zero everywhere, except for the bin corresponding to $f_0$. As the amplitude A of the input signal increases, there are crossings of higher value sound intensity levels, whereby this cochlear filter contributes more counts to the $f_0$ bin of the partial interval histogram processor. For sound intensity crossing levels equally distributed on a log amplitude scale, the partial interval histogram is related to the dB scale.

The filters whose characteristics are shown in FIGS. 9 are overlapping so that more than one partial ensemble histogram processor contributes to the $f_0$ bin. In fact, all the cochlear filters which produce $$s_i(t)=A|H_i(f_0)|\sin(2\ \pi f_0 t+\phi_i)$$

$$\phi_i=<H_i(f_0) \tag{3}$$

will contribute to the $f_0$ bin of the EIH, provided that $A|H_i(f_0)|$ exceeds any of the level crossing thresholds. Consequently, there are several spectral portion sources contributing counts to the $f_0$ bin in a nonlinear manner. The resulting inverse interval histogram obtained by combining the outputs of the partial interval histograms, e.g., by summation, corresponds to the extent of the neural response of the cochlea.

Figure 11:
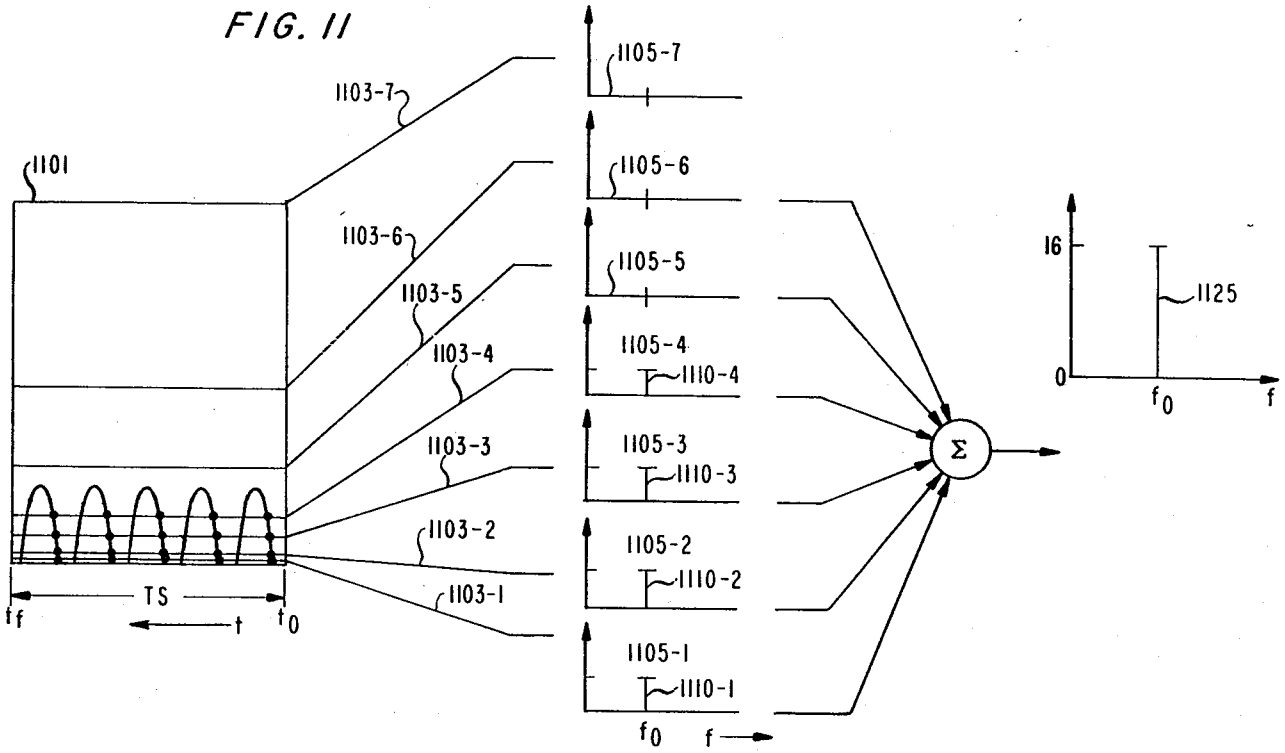
FIG. 11 illustrates diagrammatically the operation of one of the partial interval histogram processors.

FIG. 11 illustrates diagrammatically the operation of one of the partial interval histogram processors responsive to a sinewave input $$s(t)=A\sin(2\pi f_0 t) \tag{4}$$

within the passband of its associated filter. Box 1101 illustrates the level detector arrangement of a partial interval histogram processor (PIH) such as 110-1 in FIG. 1 and shows logarithmically related sound intensity threshold levels 1103-1 through 1103-7 which are incorporated in the PIH processor. The outputs of the level detector arrangement illustrated in box 1101 are applied to partial interval histogram level stores corresponding to the amplitude vs. frequency plots 1105-1 through 1105-7. The positive portions of the waveform applied to the partial interval histogram processor that occur during analysis time segment TS are shown in box 1101 and the detected intensity level points where the positive going waveform crosses levels 1103-1 through 1103-4 are indicated therein. As a result of the detected positive going crossings, an inverse interval count of 4 for level 1103-1 is stored in a memory location bin corresponding to $f_0$ line 1110-1 in plot 1105-1. In similar manner, inverse level counts of 4 are stored as shown in plots 1105-2, 1105-3 and 1105-4 as lines 1110-2, 1110-3 and 1110-4, respectively. Corresponding bins having the same frequency range of the level stores indicated in plots 1105-1 through 1105-7 are summed to form the partial interval histogram indicated in plot 1125. Since, a count of 4 is stored in each of the bins containing $f_0$ in plots 1105-1 through 1105-4, the inverse interval count in the bin for $f_0$ of plot 1125 is 16.

Figure 12:
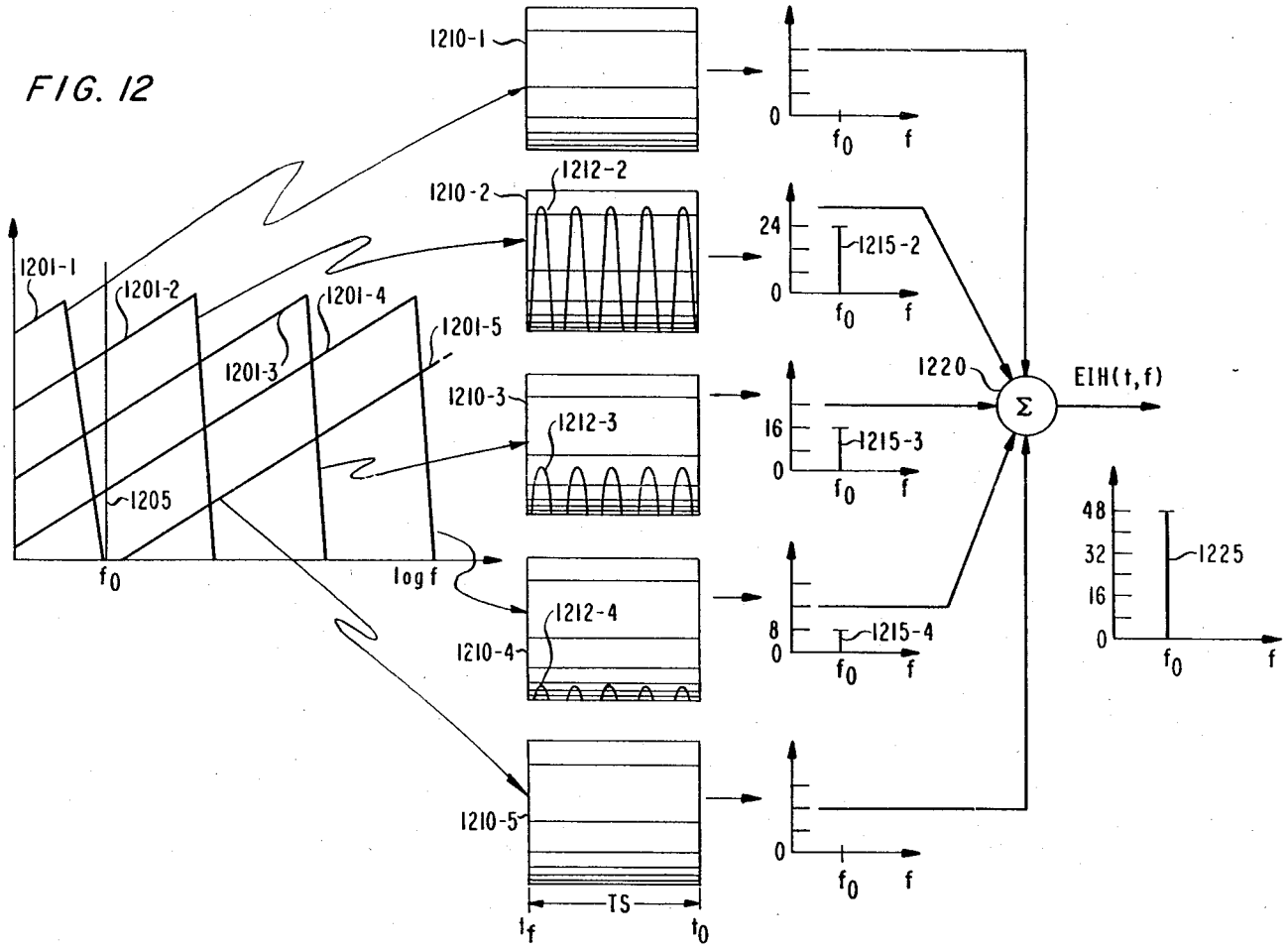
FIG. 12 illustrates diagrammatically the operation of a plurality of partial interval histogram and ensemble histogram processors of the circuit of FIG. 1.

FIG. 12 illustrates diagrammatically the operation of the plurality of partial histogram processors responsive to a sinewave signal $$s(t)=A\sin(2\pi f_0 t) \tag{5}$$

Line 1205 of FIG. 12 represents the amplitude A of this sinewave at frequency $f_0$ on a log frequency scale and the spectral characteristics of a set of 5 overlapping filters 1201-1 through 1201-5 are indicated on the same log frequency scale. Each filter exhibits a prescribed shaped spectral portion. While triangle shape spectral portions are shown, it is to be understood that the actual spectral portions correspond to the cochlear filters of FIG. 9. It is apparent that signal s(t) falls within the passbands of filter characteristics 1201-2, 1201-3, and 1201-4 but outside the passbands of filter characteristics 1201-1 and 1201-5. Boxes 1210-1 through 1210-5 diagrammatically represent the operation of the set of partial interval histogram level detection arrangements associated with filters 1201-1 through 1201-5, respectively. The horizontal lines within each of boxes 1210-1 through 1210-5 correspond to the aforementioned logarithmically related positive amplitude sound intensity crossing levels for a predetermined time segment TS.

The time segment TS for the partitioned input signal s(t) results in signal outputs from spectral filter processor 105 to partial interval histogram boxes 1210-2, 1210-3, and 1210-4, but no signal outputs to partial interval histogram boxes 1210-1 or 1210-5 as indicated.

The positive portions of the sinewave applied to boxes 1210-2, 1210-3 and 1210-4 shown as waveforms 1212-2, 1212-3 and 1212-4 result in an inverse interval count of 24 at frequency $f_0$ shown at line 1215-2 on a log frequency scale, an inverse interval count of 16 at frequency $f_0$ shown at line 1215-3 and an inverse interval count of 8 at frequency f shown at line 1215-4. These counts are summed in summer 1220 and the resultant count for the bin is indicated at line 1225 at frequency $f_0$. In general, signal s(t) is a complex speech waveform having many components so that the partial interval histogram counts and the resulting combination in the ensemble interval histogram (EIH) represents the spectrum of the speech waveform as derived from the synchrony of neural firings.

Figure 2:
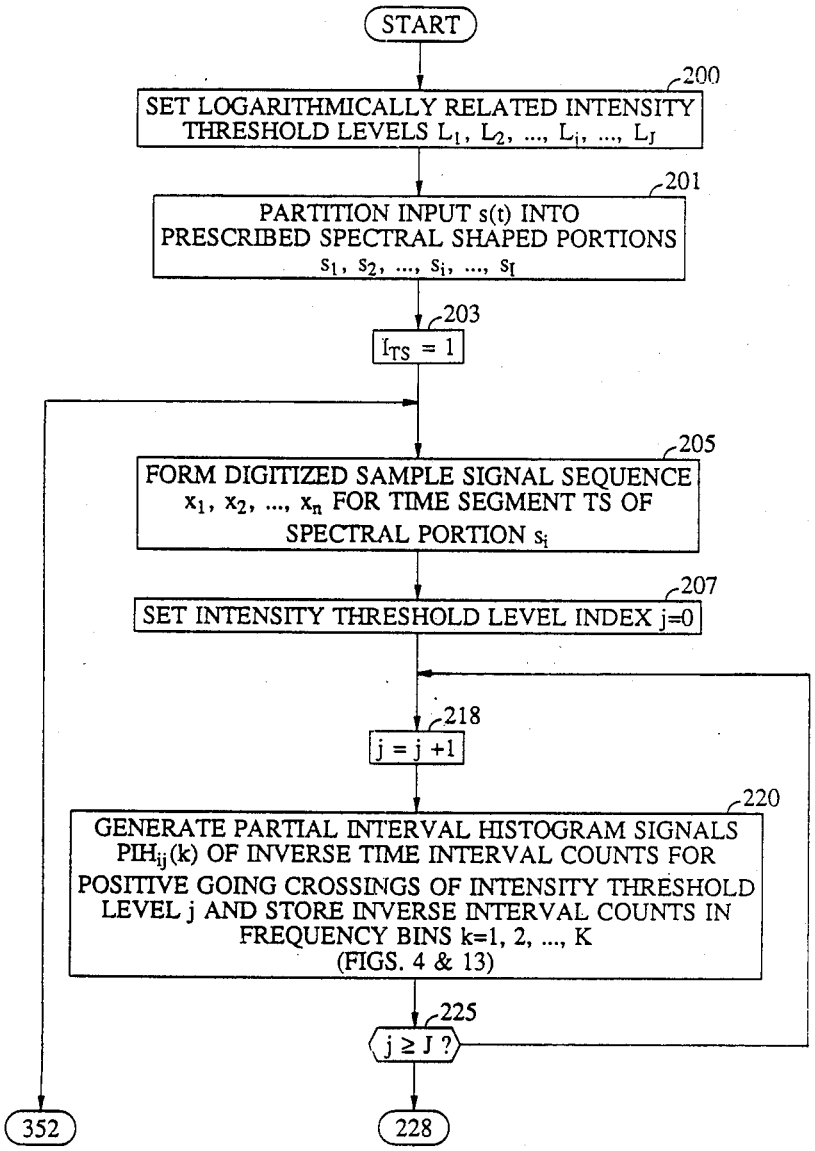
FIGS. 2, 3, 4 and 13 show flow charts illustrating the operation of the arrangement of FIG. 1.
Figure 3:
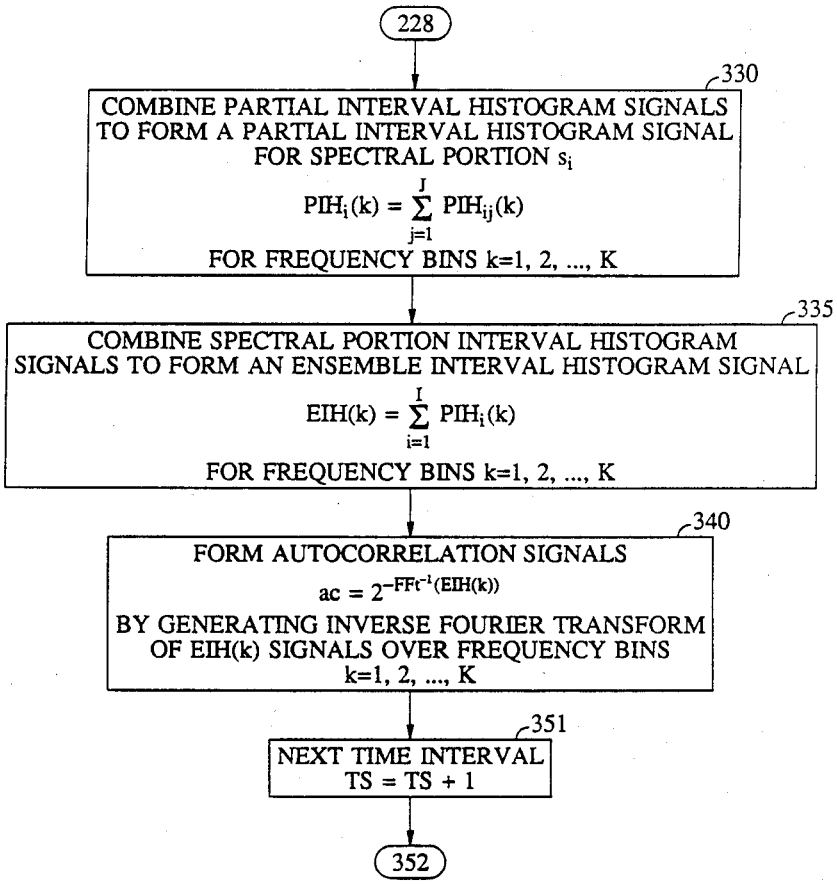

FIGS. 2 and 3 show a flow chart that illustrates the general method of operation of the circuit of FIG. 1, and the general sequence of operations of control 130 used to coordinate the signal processors in FIG. 1 is set forth in Fortran language form in Appendix A hereto. Referring to FIGS. 1, 2 and 3, step 200 is initially entered wherein a plurality of logarithmically relates sound intensity threshold levels $L_1, L_2, \ldots, L_j, \ldots, L_J$ are set in each partial interval histogram processor 110-1 through 110-I to values such as $4^j$, $j=1, \ldots, J$. The sound intensity threshold levels for each spectral portion may be the same or may differ from one another. Where the threshold levels are different, they may be set randomly with respect to one another so as to better simulate the behavior of the acoustic nerve cell arrangement. Input sound signal s(t) from transducer 101 is digitized in signal converter 103 and partitioned into I spectral portions $s_1, s_2, \ldots, s_i, \ldots, S_I$ in spectral processor 105 (step 201) in a manner well known in the art. A set of stored instructions for performing the spectral filter operations of signal converter 103 and processor 105 is shown in Fortran language form in Appendix B hereto.

Time segment index $I_{TS}$ is reset to one in step 203 and the sequence of digital codes $x_1, x_2, \ldots, x_n, \ldots, x_N$ for the spectral portion waveform, e.g., $s_i$, of the current time segment TS illustrated in FIG. 7 is formed in processor 105 (step 205). The digital code sequence for the present time segment TS spectral portion $s_1$ is applied to partial interval histogram processor 110-1 from processor 105 in step 205. Similarly, the time segment digital code sequences for spectral portions $s_2$ through $s_I$ are applied to partial histogram processors 110-2 through 110-I, respectively. Time segment TS may, for example, bet set to 40 milliseconds. The codes may be received by the partial interval histogram processor as generated, stored therein and segmented into groups of N for processing in the current and succeeding time segments TS.

Sound intensity threshold index j is reset to zero (step 207) preparatory to formation of partial interval histograms as aforementioned with respect to FIGS. 11 and 12. The partial interval histograms for the different spectral portion waveforms $s_1, s_2, \ldots, s_i, \ldots, s_I$ are produced concurrently in processors 110-1 through 110-I. The inverse interval histogram processing for spectral portion $s_i$ *l in processor* 110-*i is shown in the loop including steps* 218, 220 *and* 225. *The inverse interval histogram processing for the other spectral portions is performed concurrently so that a set of* $PIH_{ij}(k)$ partial interval histogram signals are produced where is the spectral portion index, j is the sound intensity level index and k is the histogram frequency bin index. Threshold level index j is incremented in step 218. The partial interval histogram signal set $PIH_{ij}(k)$ for the current level j and spectral portion $s_i$ is generated as per step 220 by determining the count of the time intervals between positive going crossings of threshold level j by the spectral portion waveform of the current time segment and storing the counts in storage location bins k which span the frequency range of interest, e.g., the speech spectral range. The result is a frequency distribution of the inverse time interval counts for the current time segment of spectral portion i and level j. After the partial interval histogram signals for level j are formed, threshold index incrementing step 218 is reentered via decision step 225 until the final level J has been processed.

Figure 4:
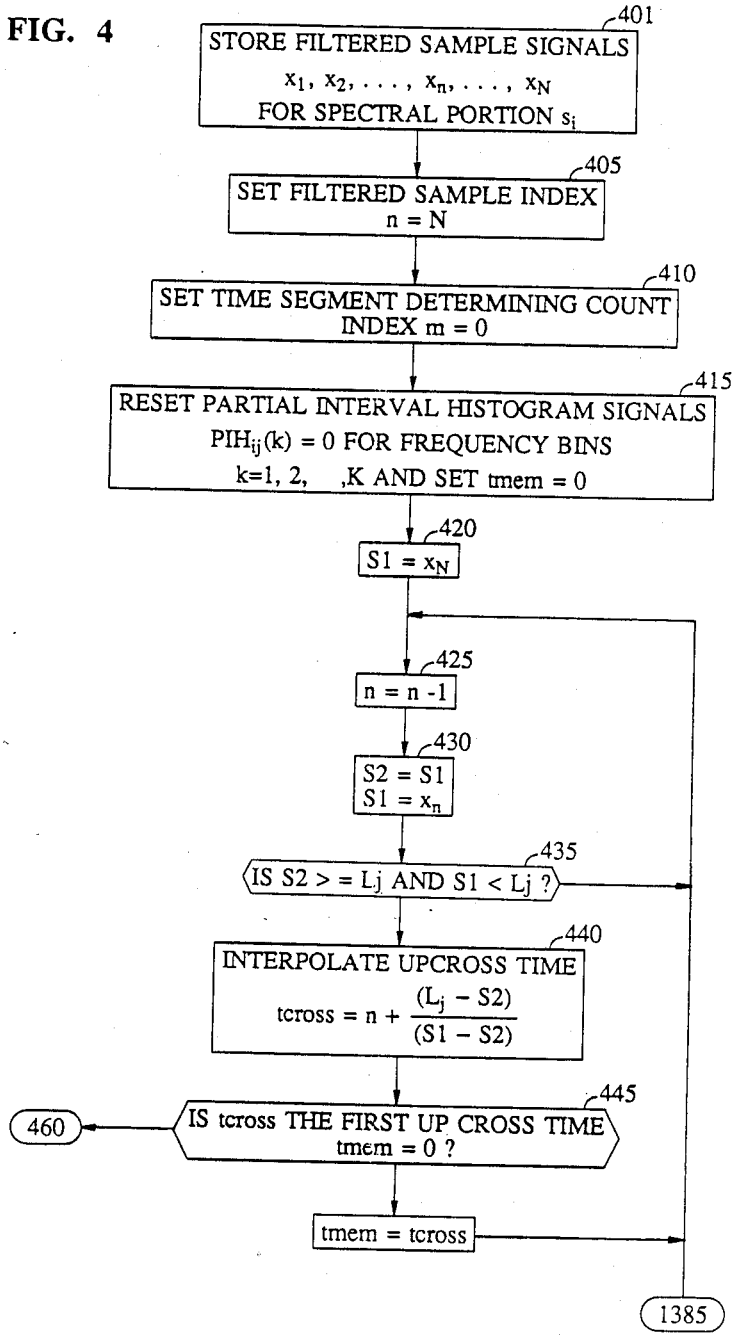
Figure 5:
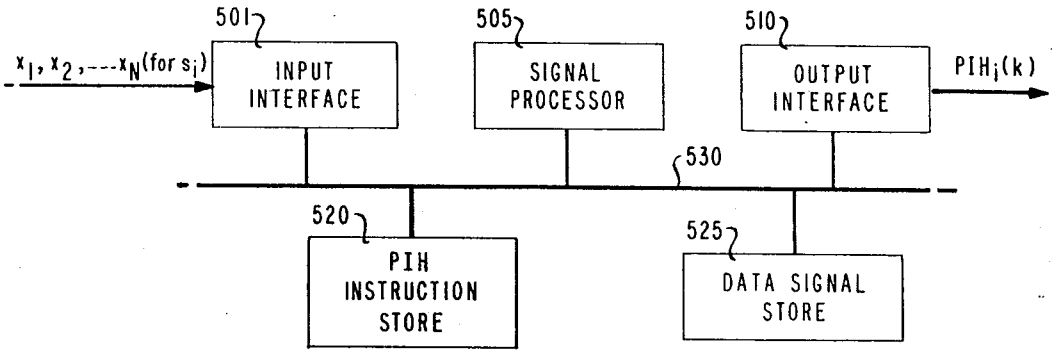
FIGS. 5 and 6 depict signal processing circuits useful in the arrangement of FIG. 1.
Figure 13:
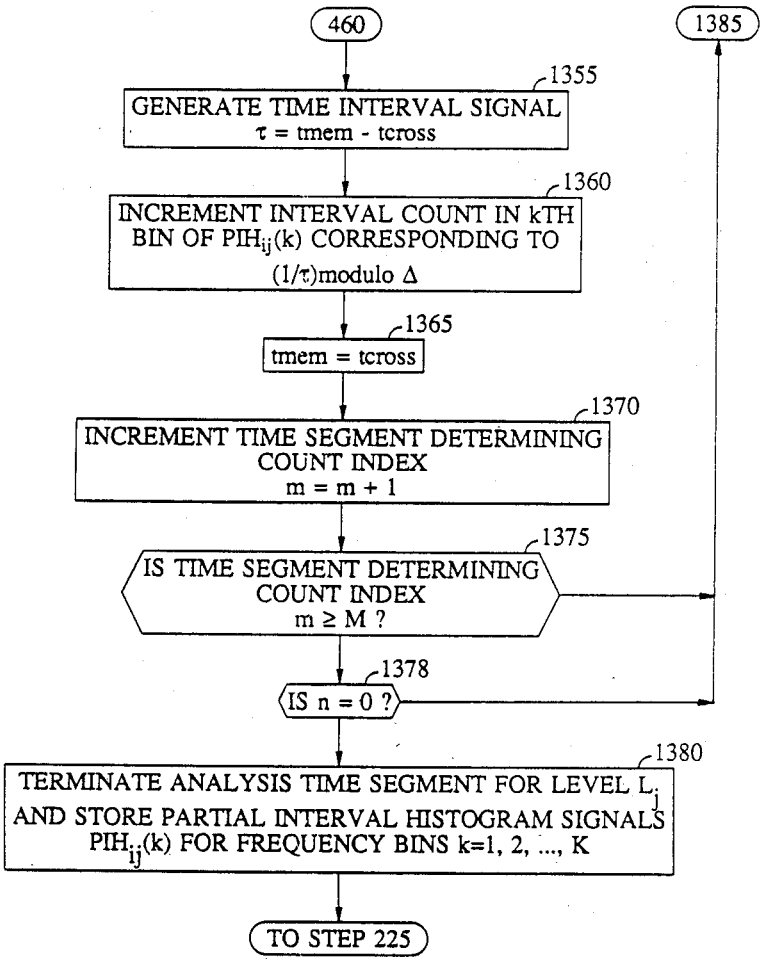

The formation of the partial interval histogram for level j of step 220 is shown in greater detail in the flow chart of FIGS. 4 and 13 with reference to the processor arrangement of FIG. 5. FIG. 5 depicts the arrangement that may be used as the partial interval histogram processor of FIG. 1. The circuit of FIG. 5 processes the partial interval histogram for one of the spectral portions, e.g., $s_i$ and comprises input interface 501, signal processor 505, partial interval histogram program instruction store 520, data signal store 525, output interface 510, and bus 530. Program instruction store 520 is a read only memory storing the instructions for implementing the partial interval histogram processing according to the flow charts of FIGS. 2 and 3. The instructions of store 520 are set forth in Fortran language in Appendix C hereto. Input interface 501 receives the sequence of digital codes $x_1, x_2, \ldots, x_N$ for the corresponding spectral portion e.g., $s_i$ from spectral filter processor 105. Signal processor 505 is adapted to perform the partial interval histogram processing operations under control of the instructions from store 520 as is well known in the art. Data signal store 525 includes $k=1, 2, \ldots K$ memory locations arranged to store the inverse interval counts for the histogram of each level j and the counts for the histogram of the combined levels $j=1, 2, \ldots, J$. Each memory location bin k receives the count of inverse intervals corresponding to a particular frequency range $\Delta$ in bin k as will be described. Output interface 510 is operative to transfer the $PIH_i(k)$ signals representing the partial histogram of inverse interval counts for all levels j of the present time segment of spectral portion i to ensemble histogram processor 115 in FIG. 5.

Referring to FIG. 4, the digital codes $x_1, x_2, \ldots, x_n$, corresponding to the spectral portion signal $s_i$ are received by input interface 501 of FIG. 5 and are transferred to data signal store 525 under control of instructions from instruction store 520 (step 401). Each sequence of N digital codes corresponds to a predefined maximum analysis time segment for which a histogram is to be formed. The filtered sample signals $x_n$ are stored (step 401). Sample index n is initially set to N in step 405 since the histogram analysis is performed on the sequence of past N samples in descending order $x_N, x_{N-1}, \ldots, x_n, \ldots, x_1$ and the time segment determining count index m set to zero (step 410) preparatory to the histogram formation. As aforementioned with respect to FIG. 10, the analysis time segment is preset, e.g. 40 milliseconds, but may be shortened to correspond to a predetermined count of inverse time intervals, e.g.

M=20 so that a finer time resolution may be obtained. Consequently, the count index m is used to determine the duration of the time segment so that the analysis time segment for higher frequency spectral portions is shortened. The partial interval histogram count signals $PIH_{ij}(k)$ for all frequency bins k=1, 2, are reset to zero (step 415) and a temporary sample storage location S1 is set to value of digital code $x_N$ (step 420) preparatory to the level detection operations in the loop from step 425 of FIG. 4 to step 1378 of FIG. 13.

Detection of a positive upgoing crossing of sound intensity threshold level j is implemented according to steps 425, 430, and 435 in which sample index n is decremented in step 425. Signal S1 is made equal to the previous sample, e.g., $x_{n+1}$ and signal S2 is set to the current sample, e.g., $x_n$ in step 430. If signal S2 corresponding to current sample $x_n$ is greater than or equal to the threshold level $L_i$ and signal S1 corresponding to the immediately preceding sample $x_{n+1}$ is less than threshold level $L_j$ (step 435), the threshold has been crossed in the upward or positive going direction and step 440 is entered. Otherwise, step 425 is reentered so that the pair of samples $x_n$ and $x_{n-1}$ may be processed.

In the event that the conditions of decision step 435 have been satisfied for current sample $x_n$ and the preceding sample $x_{n+1}$, a signal representative of the time at which the upcross of threshold level $L_j$ has occurred $$tcross = n + (L_j - S2)/(S1 - S2) \tag{6}$$

is produced by linear interpolation (step 440). Decision step 445 is then entered to determine if tcross is the time of the first positive going level j crossing in the current time segment. This is done by checking signal tmem which represents the time of the preceding crossing. If signal tmem is zero, there have been no prior crossings in the current time segment and signal tcross produced in step 445 is the first upcross. tmem is then set equal to tcross (step 450), and step 425 is reentered to detect the next upcross of level j. Otherwise a signal representing the time interval between the previous and the current upcrossings of level j $$\tau = tmem - tcross \tag{7}$$

is generated in step 1355 of FIG. 13 and the inverse interval count in the kth frequency bin of the $PIH_{ij}(k)$ histogram in data signal store 525 is incremented.

The frequency bin incrementing responsive to the inverse interval count signals performed in step 1360 wherein the count signal is placed in the bin k corresponding to the inverse of the time interval signal $(1/\tau)$ modulo $\Delta$. $\Delta$ is equal to the range of frequencies in one bin. Each frequency bin indexed by k corresponds to a predetermined frequency range $k\Delta$ to $(k+1(\Delta$ where $\Delta$ is, for example, 32 Hz. The k=1 bin may, for example, correspond to the frequency range between 32 Hz and 64 Hz while the highest frequency bin K=100 corresponds to the frequency range between 3200 Hz and 3232 Hz. Step 1365 is then entered.

In step 1365, the most recent tmem signal is made equal to the most recent tcross signal obtained in step 440. The time segment determining count index m for level j and filter i is then incremented (step 1370) and the incremented time segment determining count index m is compared to a prescribed maximum M, e.g., 20 (step 1375). As aforementioned, the histogram analysis time segment TS ends after the time period of N samples or may be terminated earlier when the maximum inverse interval count M is reached. If m is less than M in step 1375, the sample index n is tested against zero in step 1378. As long as m is less than M and n is greater than zero, step 425 of FIG. 4 is reentered to generate the next inverse interval signal for level j. Otherwise, all input samples of the time segment have been processed and the partial interval histogram signals $PIH_{ij}(k)$ for frequency bins k=1, 2, . . . , K of level j of spectral portion i are stored (step 1380). Control is then passed to step 225 of FIG. 2 in which threshold level index j is compared to the last index J. As long as index j is less than J, step 218 is reentered to process the next level to form the partial interval histogram signals $PIH_{ij}(k)$ for the set of frequency bins k=1, 2, . . . , K of the next level j.

Upon formation of partial interval histogram signal set $PIH_{iJ}(k)$ for the last level J, the partial interval histogram signals for the levels j=1, 2, . . . , J are combined by summing the level partial histogram signals to form the ith filter partial histogram signal set $$PIHi(k) = \sum_{j=1}^{J} PIH_{ij}(k) \text{ for } k = 1,2, \ldots, K \tag{8}$$

as per step 330 of FIG. 3. The partial interval histogram signal set $PIH_i(k)$ for spectral portion $s_i$ is then stored in data signal store 525 of FIG. 5. All of the partial interval histogram processors 110-1 through 110-I of FIG. 1 operate concurrently as described with respect to processor 110-i. It is readily seen from FIG. 2 and 3 that the steps described with respect to processor 110-i for spectral portion $s_i$ are the same for all partial interval histogram processors. The partial interval histogram processing steps for such other spectral portions is indicated in FIG. 3 by the arrows entering step 335.

Figure 6:
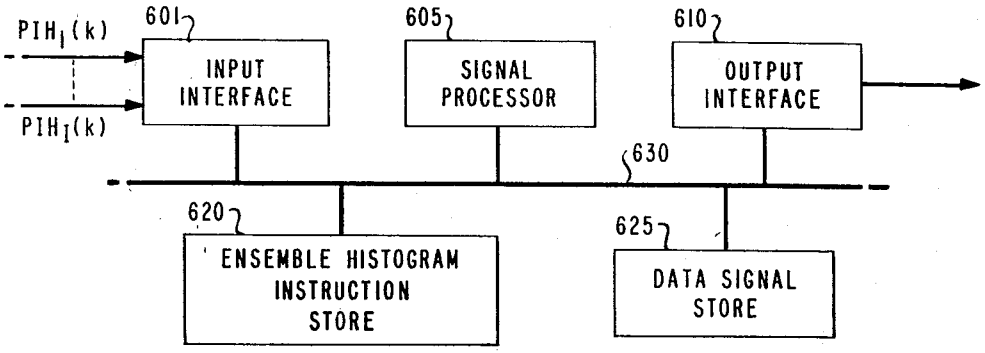

Ensemble histogram processor 115 of FIG. 1 shown in greater detail in FIG. 6 is operative to combine the signal sets $PIH_1(k)$, $PIH_2(k)$, . . . , $PIH_i(k)$, . . . , $PIH_I(k)$ for frequency bins k=1, 2, . . . , K obtained from the spectral portion partial interval histogram processors 110-1 through 110-I to form an ensemble interval histogram signal set EIH(k) by combining the filter interval histogram signals according to $$EIH(k) = \sum_{i=1}^{I} PIH_i(k) \text{ for } k = 1,2, \ldots, K \tag{9}$$

as indicated in step 335 of FIG. 3. Each EIH(k) signal for the present time segment TS corresponds to the neural response for the frequency range of bin k so that the set of EIH(k) signals represents a spectral distribution of the neural response to the input sound. The processor of FIG. 6 comprises input interface 601, signal processor 605, output interface 610, ensemble histogram formation instruction store 620, data signal store 625 and bus 630. The ensemble histogram formation instruction store is a read only memory containing a set of instruction codes adapted to implement the operations of step 335 of FIG. 3. The instructions stored in store 620 are set forth in Fortran language form in Appendix D hereto. Input interface 601 receives the partial interval histogram signal sets $PIH_1(k)$, $PIH_2(k)$, . . . , $PIH_I(k)$, . . . , $PIH_I(k)$ from processors 110-1 through 110-I and transfers them via signal processor 605 and bus 630 to data signal store 625. When all of the partial interval histogram signal sets for the present time segment are stored in the data signal store, signal processor 605 is operative to sum the corresponding frequency bin counts partial interval histogram signal sets in accordance with equation 9 to form the ensemble interval histogram signal set EIH(k) of step 335 of FIG. 3.

The ensemble histogram signal set EIH(k) represents the frequency distribution of inverse interval counts over the spectrum covered by spectral portions obtained form spectral filter processor 105 of FIG. 1. Consequently, the EIH(k) signal set corresponds to a spectrum directly related to the nerve firing pattern in the auditory nerve and the resulting spectral distribution is representative of the response of the aural sensing mechanism rather than a frequency distribution of the amplitudes of a sound pattern segment obtained by direct Fourier analysis.

Figure 8:
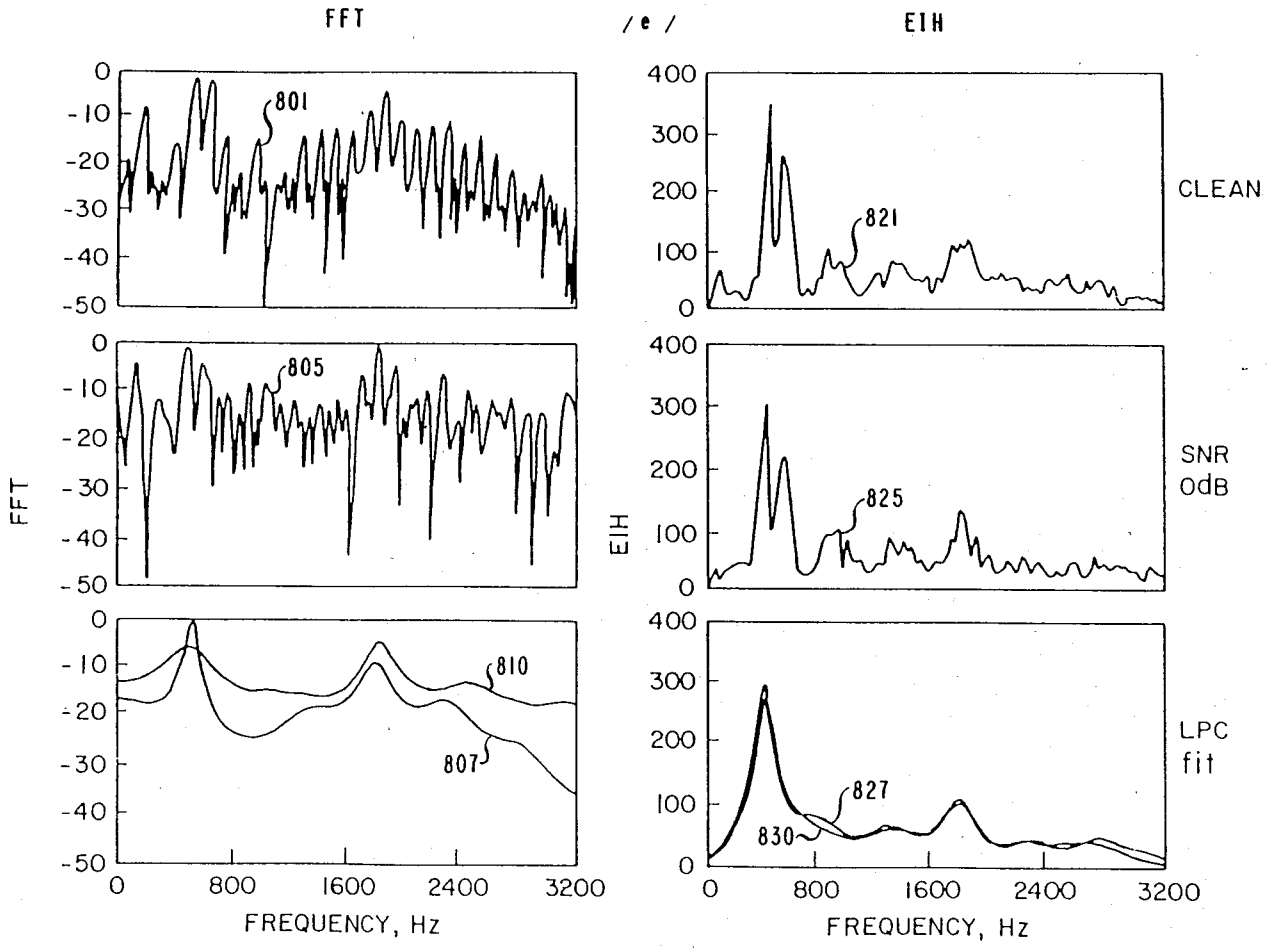
FIG. 8 show waveforms illustrating the spectral representations obtained from the arrangement of FIG. 1.

Advantageously, the use of multiple sound intensity threshold levels in the inverse interval counts and the combining of the partial interval histogram signals provides a direct measure of the intensity of the individual frequency components of the time segment neural response spectral distribution and results in a high degree of noise immunity over conventional Fourier analysis arrangements. The noise immunity is illustrated in the waveforms of FIG. 8. Referring to FIG. 8, waveform 801 is the Fourier power spectrum for the speech pattern /e/ in a noise-free environment and waveform 821 is the Ensemble Interval Histogram for the same sound obtained using the circuit of FIG. 1. Since waveform 821 represents a neural response spectral distribution rather than a Fourier type analysis, it is completely different that waveform 801. Waveform 805 represents the Fourier power spectrum for the sound /e/ obtained in a noisy environment while waveform 825 is the Ensemble Interval Histogram for the same sound in the same noisy environment. While there are marked differences between the power spectrums of waveforms 801 and 805 attributable to noise, there are only minor differences between Ensemble Interval waveforms 821 and 825. Further in this regard, the LPC fit waveforms 807 and 810 for the noise-free and noisy power spectra of waveforms 801 and 805 show significant disparities but the LPC fit for the Ensemble Interval Histogram waveforms 821 and 825 indicate very minor differences. The LP fit arrangements and waveforms are discussed on page 431 of the volume Digital Processing of Speech Signals, by L. R. Rabiner and Schafer, Prentice Hall 1978.

The ensemble interval histogram arrangement according to the invention may be utilized in many sound processing applications. One example of its use, i.e. forming autocorrelation signals for speech recognition arrangements, is illustrated in the circuit of FIG. 1. The ensemble interval histogram signal set EIH(k) for the current time segment is transferred to inverse FFT and autocorrelation signal processor 120 wherein an inverse Fourier transform of the 2 to the power of the EIH(k) signal set is generated as per step 340 of FIG. 3 and autocorrelation signals are produced in accordance with $$ac(j)=FFT^{-1}(2^{EIH(k)})\ k=1, 2, \ldots, ; j=1, 2, \ldots \qquad (10)$$

The $FFT^{-1}$ processing arrangements described in chapter 8.2 of *Programs for Digital Signal Processors* published by the IEEE Press, 1974, may be used to convert the spectral distribution signals from EIH processor 115 to an equivalent autocorrelation domain signal in processor 120. The autocorrelation signals obtained from processor 120 are applied to utilization device 125 which may comprise an automatic speech recognizer well known in the art utilizing such autocorrelation signals. Each time segment in FIG. 1 is set to a time frame of the speech recognizer and the autocorrelation obtained from processor 120 correspond to the spectral distribution signals of the auditory model neural response for the time frame with appropriate intensity weighting. Appendix E hereto sets forth in Fortran language form the instructions for operation of processor 120.

The invention has been illustrated and described with reference to a particular embodiment thereof. It is to be understood, however, that various changes and modifications may be made by those skilled in the art without departing form the spirit and scope of the invention.

APPENDIX A - General Processing

```
program main

character*50 spfil
integer isout(85,36216)
integer peih(85,50,100),eih(50,100)
dimension ac(10,50)

call filters(spfil,isout)                    ;filtering. input=buffer spfil~201
                                             ;output=array isout

peih=0
call peih(isout,peih)

eih=1
call eih(peih,eih)

call eihtoac(eih,ac)

end
```

APPENDIX B - Spectral Portion Filtering

```
      subroutine filters(spfil,isout)

      character*50 spfil,outfil,fiber
      real h(161)
      real hcoc(85,1024)
      complex bc(512),sc(2049)
      real b(1024),s(4098),st(17,1024),res(2048)
      integer*2 is(2048)
      integer isin(17,2048),isout(85,36216)
      equivalence (b,bc),(s,sc)

      h=0.
      call openas(5,'/usr/jgw/noise/lpfiltr',0)          ;load upsampling filter
      read(5,71) nfilt
 71   format(15x,i4)
      read(5,72) (h(j),j=1,(nfilt+1)/2)
 72   format(7f11.7)
      close (5)

      do 87 icoc=1,85                                    ;load cochlear filters
      write(fiber,81) icoc
 81   format('/usr/jgw/noise/dircoc/h.'z2.2)
      call rdsi(5,fiber)
      b=0.
      p1=1.
      call rsect(5,b,2048,p1,ieof)
      close (5)
      hcoc(icoc,1:1024)=b(1:1024)
 87   continue


c.............................................
c     READ INPUT SPEECH FROM BUFFER spfil AND UPSAMPLE
c     FROM 6667 TO 40,000 SAMPLES PER SECONDS (1:6)
c     TO BUFFER outfil
c.............................................
      iscal=0
      idec=1
      inter=6
      nfilt=161
      write(*,*)' conversion in progress ...'
      call src(spfil,outfil,h,nfilt,idec,inter,iscal)
      write(*,*)' sampling rate conversion completed'


c.............................................
c     READ 17 BLOCKS (2048 SAMPLES EACH) OF UPSAMPLED
c     INPUT SPEECH FROM BUFFER outfil TO ARRAY isin
c.............................................
      call rdsi(5,outfil)
      isin=0
      do 86 nblk=1,17
      p1=2048*(nblk-1)+1
```

```
      call rsect(5,is,2048,p1,ieof)
      isin(nblk,1:2048)=is(1:2048)
86    continue
      close(5)


c.....................
c     COMPUTE FFT OF ARRAY isin INTO ARRAY st      ; ~ 201
c.....................
      do 86 nblk=1,17
      s(1:2048)=float(isin(nblk,1:2048))
      s(2049:4098)=0.
      call fast(s,4096)
      st(nblk,1:1024)=s(1:1024)
86    continue


c.....................
c     FILTER THE INPUT BY COCHLEAR FILTER icoc, INTO ARRAY isout      ; ~ 201
c.....................
      isout=0
      do 83 icoc=1,85
      b(1:1024)=hcoc(icoc,1:1024)
      res=0.
      do 87 nblk=1,17
      s(1:1024)=st(nblk,1:1024)
      sc(1:512)=sc(1:512)*bc(1:512)
      sc(513:2049)=0.
      call fsst(s,4096)
      do 85 i=1,2048
      k=2048*(nblk-1)+i+1400
85    isout(icoc,k)=s(i)+res(i)
      res(1:2048)=s(2049:4096)
87    continue
83    continue

      return
      end

      subroutine ihmlc(m,ith,idis,ih)

      integer ih(100),iy(1600),idis(1600)
      epsy=1.e-5

      nstop=1599

      iy=idis                                    ;idis contains N=1600 samples
      call zcmlp(iy,ith,nstop)                   ;detect upgoing level crossings
      do 12 i=1,nstop
      if(iy(i).eq.0) go to 12
      to=float(i)
      denum=float(idis(i+1)-idis(i))
      if(abs(denum).lt.epsy) go to 12
      if(idis(i).ne.ith) to=to+float(ith-idis(i))/denum    ;1st crossing
      iy(i)=0
      go to 13                                   ; ~ 350
```

```
12  continue
13  nctr=0
    do 14 i=1,nstop
    if(iy(i).eq.0) go to 14
    nctr=nctr+1                                  ; ~ 370
    tom1=float(i)
    denum=float(idis(i+1)-idis(i))
    if(abs(denum).lt.epsy) go to 14
    if(idis(i).ne.ith) tom1=tom1+float(ith-idis(i))/denum     ;ith crossing
    dt=tom1-t                                    ; ~ 355
    to=tom1                                      ; ~ 365
    iy(i)=0
    if(abs(dt).lt.epsy) go to 14
    freq=40000./dt
    ibin=freq/32.                                ; corresponding bin number .. ~ 360
    ih(ibin)=ih(ibin)+1                          ; increment the right bin  .. ~ 360
    if(nctr.eq.20) go to 99                      ; ~ 375
14  continue
99  return
    end

    subroutine zcmlp(ix,ith,nstop)

    integer ix(*)

c.................

c     DETECT UPGOING LEVEL CROSSINGS .. ~ 325, 330, 335
c................

    do 1 i=1,nstop
    ip1=i+1
    if((ix(i).le.ith).and.(ix(ip1).gt.ith)) then
                                        ix(i)=1
    else
                                        ix(i)=0
    end if
1   continue
    return
    end

c
    subroutine rmaxim(nl,nh,x,imax,xmax)
    real x(*)
c
c   COMPUTES THE MAX VALUE OF X AND ITS POSITION
c
    xmax=x(nl)
    imax=nl
    nlp1=nl+1
    do 1 i=nlp1,nh
    if(x(i).le.xmax) go to 1
    xmax=x(i)
    imax=i
1   continue
    return
    end
```

APPENDIX C - Partial Interval Histogram Processing

```
      subroutine peih(isout,peih)

      integer ith(7),isout(85,36216),isig(1600)
      integer ihfib(100),ihsum(100)
      integer peih(85,50,100)

      do 85 i=1,7                                  ;load crossing levels    ~ 200
      ith(i)=4**i
85    continue

      do 89 icoc=1,85
      do 88 its=1,50                               ; ~ 250

      do 23 i=1,1600                               ; ~ 205
      ir=1601-i
      k=200*(its-1)+i
23    isig(ir)=isout(icoc,k)

      ihfib=0
      ihsum=0
      max=maxval(isig)
      do 20 j=1,7                                  ;compute peih  ~ 218, 250
      jth=ith(j)
      if(max.lt.jth) go to 20
      call ihmlc(j,jth,isig,ihfib)                 ; ~ 220
      ihsum(2:99)=ihsum(2:99)+ihfib(2:99)          ; ~ 230
      ihfib=0
20    continue

24    peih(icoc,its,2:99)=peih(icoc,its,2:99)+ihsum(2:99)     ; ~ 230

88    continue
89    continue

      return
      end
```

APPENDIX D - Ensemble Interval Histogram Processing

```
      subroutine eih(peih,eih)

      integer peih(85,50,100),eih(50,100)

      do 82 icoc=1,85                              ;compute eih
      eih(1:50,1:100)=eih(1:50,1:100)+peih(icoc,1:50,1:100)     ; ~ 235
82    continue

      return
      end
```

APPENDIX E - Autocorrelation Signal Processing

```
      subroutine eihtoac(eih,ac)

      integer eih(50,100)
      dimension ac(10,50),acscr(100)
      complex*8 xs(256)

      do 55 its=1,50                          ;compute autocorr. coeff.  for the recognizer
      acscr(1:100)=float(eih(its,1:100))
      call rmaxim(1,100,acscr,imax,hmax)
      scl=5./hmax
      acscr(1:100)=(acscr(1:100)-1.)*scl
      do 57 i=1,256
57    xs(i)=cmplx(1.,0.)
      xs(1)=2.**(acscr(1))
      do 58 i=2,100
      ir=258-i
      xs(i)=2.**(acscr(i))                    ; 2**eih .. ~ 240
58    xs(ir)=xs(i)
      call ifft(xs,256)                       ; inverse FFT on 2**eih .. ~ 240
      do 59 i=1,10
59    ac(i,its)=real(xs(i))                   ; 10 autocorr. coeff. .. ~ 245
55    continue

      end
```

What is claimed is:

1. A method for analyzing a sensory type pattern comprising:

receiving a sensory type pattern;

dividing the frequency spectrum of the waveform of the received sensory type pattern into a plurality of spectral portions;

partitioning each spectral portion of the received sensory type pattern into successive time segments;

defining threshold levels of intensity of each such partitioned spectral portion for which crossings are to be detected, said levels corresponding one-to-one to sensory neutral response intensity levels;

detecting the crossings of each such threshold level of intensity and determining the inverse time intervals therebetween;

classifying said inverse time intervals;

generating a signal representative of the classification of inverse time intervals for each partitioned spectral portion; and producing a signal representative of the distribution of the generated classification signals for the current time segment waveform of the sensory type pattern.

2. A method for analyzing a sensory type pattern according to claim 1 wherein said intensity threshold level defining step comprises forming a plurality of spaced intensity threshold level signals over a predetermined intensity range of said partitioned spectral portion, and the step of detecting crossing and determining inverse time intervals comprises determining the time interval between each pair of successive same direction crossings of each intensity threshold level, the classification step comprises setting ranges of such inverse time intervals, and the step of generating a signal representative of the classification comprises generating a signal representative of the count of inverse time intervals within each such range of said inverse time intervals.

3. A method for analyzing a sensory type pattern according to claim 2 wherein said distribution representative signal producing step comprises combining the generated signals representative of the counts of inverse time intervals within the respective ranges to form a signal representative of said distribution for each spectral portion in said current item segment.

4. A method for analyzing a sensory type pattern according to claim 3 including the step of summing the count signals of each spectral portion inverse time interval range for all spectral portions to form a signal representative of an activity level for said sensory type pattern in said time segments.

5. A method for analyzing a sensory type pattern according to claim 4 wherein the step of defining threshold levels of intensity for which crossings are to be detected comprises defining intensity threshold levels which are logarithmically spaced.

6. A method for analyzing a sensory type pattern according to claim 5 further comprising generating a resultant signal representative of a property analogous to autocorrelation of the current time segment of said received sensory type pattern including raising the base of said logarithmic spacing to the power of the activity level signal, and forming the inverse fast Fourier transform of the result of the previous step.

7. A method for analyzing a sensory type pattern according to claim 1 wherein the step of partitioning each spectral portion of the received pattern into successive time segments comprises:

assigning a nominal time duration to the time segment for each spectral portion;

generating a first signal corresponding to a nominal number of crossings of the threshold levels of intensity corresponding to the neural response intensity levels by the spectral portion waveform in said nominal duration;

generating a second signal corresponding to the actual number of crossings of the threshold levels of intensity by the spectral portion waveform in said nominal duration;

subtracting the first signal from the second signal; and in response to the subtracting step, determining the actual analysis duration of the time segment by limiting said actual time segment duration so that the actual number of crossings do not significantly exceed the nominal number.

8. A method for analyzing a sensory type pattern according to claim 7 wherein limiting the duration of each spectral portion time segment comprises setting the duration for each spectral portion to the nominal duration when the actual number of crossings is less than said nominal number of crossings and to the duration corresponding to the nominal number of crossings when the actual number of crossings exceeds said nominal number of crossings.

9. A method for analyzing a sensory type pattern according to claim 2 wherein the spaced intensity threshold level signals of each spectral portion are different from the spaced intensity threshold level signals of the adjacent spectral portions.

10. A method for analyzing a sensory type pattern according to claim 2 wherein the spaced intensity threshold level signals of each spectral portion are randomly related to the spaced intensity threshold level signals of the adjacent spectral portions.

11. A method for analyzing a sensory type pattern according to claim 1, 2, 3, or 4 wherein said sensory type pattern is a sound pattern.

12. Apparatus for analyzing a sensory type pattern comprising:

means for receiving a sensory type pattern;

means for dividing the frequency spectrum of the received sensory type pattern into a plurality of spectral portions;

means for partitioning each spectral portion of the received sensory type pattern into successive time segments;

means for defining threshold levels of intensity of each such partitioned spectral portion for which crossings are to be detected corresponding one-to-one to sensory neural response intensity levels;

means for detecting the crossings of each such threshold level of intensity and determining the inverse time intervals therebetween;

means for classifying said inverse time intervals;

means for generating a signal representative of the classification of inverse time intervals for each partitioned spectral portion; and means for producing a signal representative of the distribution of the generated classification signals for the time segment waveform of the sensory type pattern.

13. Apparatus for analyzing a sensory type pattern according to claim 12 wherein said intensity threshold level defining means comprises means for forming a plurality of spaced intensity threshold level signals over a predetermined intensity range of said partitioned spectral portion; and the detecting and determining means comprises;

means for determining the time interval between each pair of successive same direction crossings of each intensity threshold level, the classification means comprises means for setting ranges of inverse time intervals, and the means for generating a signal representative of the classification comprises means for generating a signal representative of the count of inverse time intervals within each such range of said inverse time intervals.

14. Apparatus for analyzing a sensory type pattern according to claim 13 wherein said distribution representative signal producing means comprises means for combining the generated signals representative of the counts of inverse time intervals within the respective ranges to form a signal representative of said distribution for each spectral portions in said current time segment.

15. Apparatus for analyzing a sensory type pattern according to claim 14 additionally including means for summing the generated count signals of each spectral portion inverse time interval range for all spectral portions to form a signal representative of an activity level for said sensory type pattern in said time segment.

16. Apparatus for analyzing a sensory type pattern according to claim 15 wherein the means for defining threshold levels of intensity for which crossings are to be detected comprises means for defining intensity threshold levels which are logarithmically spaced.

17. Apparatus for analyzing a sensory type pattern according to claim 16 further comprising means for generating a resultant signal representative of a property analogous to autocorrelation of the current time segment of said received sensory type pattern including means for raising the base of said logarithmic spacing to the power of the activity level signal; and means for forming the inverse fast Fourier transform of the output of the raising means.

18. Apparatus for analyzing a sensory type pattern according to claim 12 wherein the means for partitioning each spectral portion of the received pattern into successive time segments comprises:

means for assigning a nominal time duration to the time segment for each spectral portion;

means for generating a first signal corresponding to a nominal number of crossings of the intensity threshold levels by the spectral portion waveform in said nominal duration;

means for generating a second signal corresponding to the actual number of crossing of the threshold levels of intensity by the spectral portion waveform in said nominal duration;

means for substracting the first signal from the second signal; and means respective to the substracting means for limiting said actual time segment duration so that the actual number of crossing do not significantly exceed the nominal number.

19. Apparatus for analyzing a sensory type pattern according to claim 18 wherein the means for limiting the duration of each spectral portion time segment comprises means for setting the duration for each spectral portion to the nominal duration when the number of crossings is less than said nominal number of crossings and to the duration corresponding the nominal number of crossings when the number of crossings exceeds said nominal number of crossings.

20. Apparatus for analyzing a sensory type pattern according to claim 13 wherein the spaced intensity threshold level signals of each spectral portion are different from the spaced intensity threshold level signals of the adjacent spectral portions.

21. Apparatus for analyzing a sensory type pattern according to claim 20 wherein the different spaced intensity threshold level signals of each spectral portion are randomly related to the spaced intensity threshold level signals of the adjacent spectral portions.

22. Apparatus for analyzing a sensory type pattern according to claim 12, 13, 14, or 15 wherein said sensory type pattern is a sound pattern.

23. The method of characterizing a bandlimited signal which has been partitioned into a plurality, N, of components signals, each of said component signals being substantially contained within a respective frequency sub-band, comprising determining a distribution function, $f_i(T)$, of the time interval, T, between crossings by the ith of said component signals, $i=1,2 \ldots ,N$, of at least one threshold value, and linearly combining a plurality of said distribution functions to derive a composite distribution function.

24. The method of claim 23 wherein said linearly combining comprises substantially linearly combining all N of said distribution functions.

25. The method of claim 23, wherein the step of determining comprises determining a distribution function, $f_i(t)$, of the time interval, T, between "same-sense" crossing by said ith signal of at least one threshold value.

26. The method of claim 25, wherein the determining step comprises determining said distribution function of the time interval, T, between "same-sense" crossings by said ith signal of a single threshold value.

27. The method of claim 23, wherein the determining step comprises determining a distribution function, $f_i(t)$, of the time interval, T, between crossings by said ith signal of at least one threshold value for crossings occurring during a period of time, t, generally inversely related to the frequencies present in the ith sub-band.

28. The method of claim 2, wherein the determining step comprises determining the distribution function, $f_i(t)$ of the time interval, T, between crossings occurring during the period of time, t, further limited to a selected maximum time period.

29. The method of claim 23 in which the determining step determines a distribution function, $f_{ij}(T)$, of the values for successive times, T, at which the ith sub-band signal crosses the jth of a plurality of threshold values, and the linearly combining step includes combining a plurality of partial distribution functions for a plurality of said levels for each of a plurality of said sub-band signals.

30. The method of claim 29, wherein the step of determining comprises determining a distribution function, $f_{ij}(T)$, of the time interval, T, between "same-sense" crossing by said ith signal of each of a plurality of j threshold values.

31. The method of claim 30, wherein the determining step comprises determining a distribution function, $f_{ij}(t)$, of the time interval, T, by said ith signal of each of a plurality of j threshold values occurring during a period of time, t, generally inversely related to the frequencies present in the ith sub-band.

32. The method of claim 31, wherein the determining step comprises determining the distribution function, $f_{ij}(T)$ of the time interval, T, between crossings occurring during the period of time, t, further limited to a selected maximum time period.

33. The method of claim 32, wherein said linearly combining comprises substantially linearly combining all of said distribution functions.

34. The method of claim 29 in which the plurality of threshold values are logarithmically spaced.

35. The method of claim 34 in which the linearly combining step comprises substantially linearly combining all of said distribution functions.

36. The method of either claim 33 or claim 35 in which the determining step includes partitioning each of the sub-band signals into time-frames segments for analysis of the time differences, T, occurring in said distribution function, $f_{ij}(T)$, and extending said analysis to include past time frame segments whenever occurrences of time differences, T, are below a minimum number of occurrences, up to a maximum number of past time frame segments.

37. The method of claim 35 further including generating a signal representative of a property analogous to the autocorrelation of the combined distribution function portion for the current time segment, including raising the base of said logarithmic spacing to the power of the combined distribution functions, and forming the inverse fast Fourier transform of the result of the raising step.

38. The method of claim 23 in which the plurality, N, of sub-band signals each substantially overlaps with its nearest neighbor sub-band signals on either side.

39. The method of claim 38 in which each of the plurality, N, of sub-band signals is a band-pass signal having a lower cut-off frequency which is non-zero.

40. The method of any one of the claims 23, 24, 25, 26, 27, 28, 29, 30, 31, 32, 33, 34, 35, 37, 38 or 39 wherein the bandlimited signal is derived from an acoustic signal.

41. The method of any one of claims 23, 24, 25, 26, 27, 28, 29, 30, 31, 32, 33, 34, 35, 37, 38 or 39 wherein the bandlimited signal is derived from speech.

* * * * *